US006097823A

United States Patent [19]

Kuo

[11] Patent Number: 6,097,823

[45] **Date of Patent: *Aug. 1, 2000**

[54] DIGITAL HEARING AID AND METHOD FOR FEEDBACK PATH MODELING

[75] Inventor: Sen M. Kuo, DeKalb, Ill.

[73] Assignee: Texas Instruments Incorporated, Dallas, Tex.

[ * ] Notice: This patent is subject to a terminal disclaimer.

[21] Appl. No.: 08/992,777

[22] Filed: Dec. 17, 1997

Related U.S. Application Data

[60] Provisional application No. 60/033,105, Dec. 17, 1996.

[51] Int. Cl.[7] ..... H04R 25/00

[52] U.S. Cl. ..... 381/312; 381/71.11; 381/317; 381/318

[58] Field of Search ..... 381/71.11, 71.12, 381/71.8, 312, 318, 320, 321, 120, 121

[56] References Cited

U.S. PATENT DOCUMENTS 5,402,496 3/1995 Soli et al. .
5,940,519 8/1999 Kuo ..... 381/71.11

*Primary Examiner*—Curtis A. Kuntz
*Assistant Examiner*—Phylesha Dabney
*Attorney, Agent, or Firm*—Robert D. Marshall, Jr.; W. James Brady, III; Frederick J. Telecky, Jr.

[57] ABSTRACT

A digital hearing aid (10) is provided that includes a microphone (12), a control and modeling circuitry (18), and a receiver (20). The microphone (12) receives an input sound signal x(t) and generates a digital input signal x(n) in response. The control and modeling circuitry (18) filters and amplifies the digital input signal x(n) and performs feedback neutralization and feedback path modeling to generate a digital output signal y(n). The receiver (20) receives the digital output signal y(n) and generates an output sound signal y(t) in response.

10 Claims, 2 Drawing Sheets

DIGITAL HEARING AID AND METHOD FOR FEEDBACK PATH MODELING

This application claims priority under 35 USC 119(e) (1) of provisional application number 60/033,105, filed Dec. 17, 1996.

RELATED APPLICATIONS

This application is related to the following co-pending U.S. Provisional Applications: Ser. No. 60/033,458 filed Dec. 17, 1996, now U.S. Pat. No. 5,940,519 entitled *Active Noise Control System and Method for On-Line Feedback Path Modeling and On-Line Secondary Path Modeling*; Ser. No. 60/033,104 filed Dec. 17, 1996, now U.S. patent application Ser. No. 08/992,699 filed Dec. 17, 1997 entitled *Off-Line Feedback Path Modeling Circuitry and Method for Off-Line Feedback Path Modeling*; Ser. No. 60/033,106 filed Dec. 17, 1996, now U.S. patent application Ser. No. 08/991,726 filed Dec. 16, 1997 entitled *Active Noise Control System and Method for On-Line Feedback Path Modeling*; and Ser. No. 60/033,107 filed Dec. 17, 1996, now U.S. patent application Ser. No. 08/992,933 filed Dec. 17, 1997 entitled *Off-Line Path Modeling Circuitry and Method for Off-Line Feedback Path Modeling and Off-Line Secondary Path Modeling.*

TECHNICAL FIELD OF THE INVENTION

This invention relates generally to the field of control systems and more particularly to a digital hearing aid and method for feedback path modeling.

BACKGROUND OF THE INVENTION

Feedback is a common problem in hearing aids, especially in-the-ear ("ITE") type hearing aids, and adversely affects overall hearing aid operation and performance. The feedback limits the maximum usable gain of the hearing aid and degrades overall system response. Feedback in a hearing aid includes both acoustical and mechanical feedback. Acoustical feedback occurs when a portion of the output sound signal is provided back to the input of the hearing aid. The portion of the sound signal that travels back to the input will generally travel through a vent or through any acoustical leakage path that may exit between the hearing aid shell and the ear into which the hearing aid is inserted. Mechanical feedback is caused by the vibrations of the receiver being transmitted back to the microphone through the tubes and the walls of the hearing aid shell.

Prior attempts at solving the feedback problem have focused on feedback cancellation which includes estimating the feedback signal and subtracting it from the input signal provided to the microphone of the hearing aid. These prior attempts are discussed in James M. Katz, *Feedback Cancellation in Hearing Aids*: Results from a *Computer Simulation*, IEEE Transactions on Signal Processing, Vol. 39, No. 3, pp. 553–562, 1991. Prior feedback cancellation techniques may be divided into two areas.

The first area involves providing a fixed filter, with fixed filter coefficients or taps, that cannot adjust to changes in the acoustical feedback path. This solution has proven unsatisfactory because changes in the acoustical environment occur frequently and thus the fixed filter no longer accurately models the feedback path and cannot provide accurate results. For example, changes in the acoustical environment may occur when a telephone receiver is moved close to the aided ear or when a hand is brought to the hearing aid to adjust the volume control. Other examples of changes in the acoustical environment include when the hearing aid shifts or adjusts in the user's ear, which often occurs when the user is eating or talking. Thus, the fixed filter feedback cancellation technique has proven unsatisfactory in solving the feedback problem.

A second approach at solving the feedback problem using feedback cancellation involves estimating the effects of the feedback path using a digital adaptive system. The digital adaptive system updates the estimated feedback path whenever changes are detected in the feedback behavior. The criterion for determining when a change has occurred in the feedback behavior is the onset of oscillation. When oscillation is detected, the normal hearing aid processing is interrupted and stopped and a pseudorandom noise burst is injected into the feedback path and a set of digital filter coefficients are adjusted to update the estimate of the feedback path. The hearing aid is then returned to normal operation with the feedback cancellation filter using the updated filter coefficient or taps. This approach suffers from several problems and disadvantages. This noncontinuous estimation approach fails to detect small changes in the feedback path if these changes do not cause oscillation or instability. Another disadvantage includes a reduction in speech intelligibility as a result of the feedback cancellation being disabled while the feedback path is being modeled.

SUMMARY OF THE INVENTION

From the foregoing it may be appreciated that a need has arisen for a digital hearing aid and method for feedback path modeling that eliminate or reduce the problems described above. In accordance with the present invention, a digital hearing aid and method for feedback path modeling are provided that employ a signal processing solution to the feedback path problem by continuously modeling the feedback path and neutralizing its effects so that the digital hearing aid will operate more accurately. This is accomplished while the feedback path is changing and while the hearing aid is filtering and amplifying an input sound signal.

According to an embodiment of the present invention, a digital hearing aid is provided that includes a microphone, a control and modeling circuitry, and a receiver. The microphone receives an input sound signal and generates a digital input signal in response. The control and modeling circuitry filters and amplifies the digital input signal while also performing feedback neutralization and feedback path modeling to generate a digital output signal. The receiver, which may be implemented as a speaker in one embodiment, receives the digital output signal and generates an output sound signal in response.

The present invention provides various technical advantages. A technical advantage of the present invention includes the ability to accurately and continuously perform feedback path modeling to improve overall digital hearing aid performance. Another technical advantage of the present invention includes the ability to implement the present invention using existing digital signal processing techniques and algorithms. Yet another technical advantage of the present invention includes increased hearing aid stability due to the continuous modeling of the feedback path and the elimination of the feedback path effects. Still another technical advantage of the present invention includes significant improvements in the signal-to-noise ratio because of the improved feedback path modeling. Other technical advantages are readily apparent to one skilled in the art from the following FIGUREs, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE INVENTION

Figure 1:
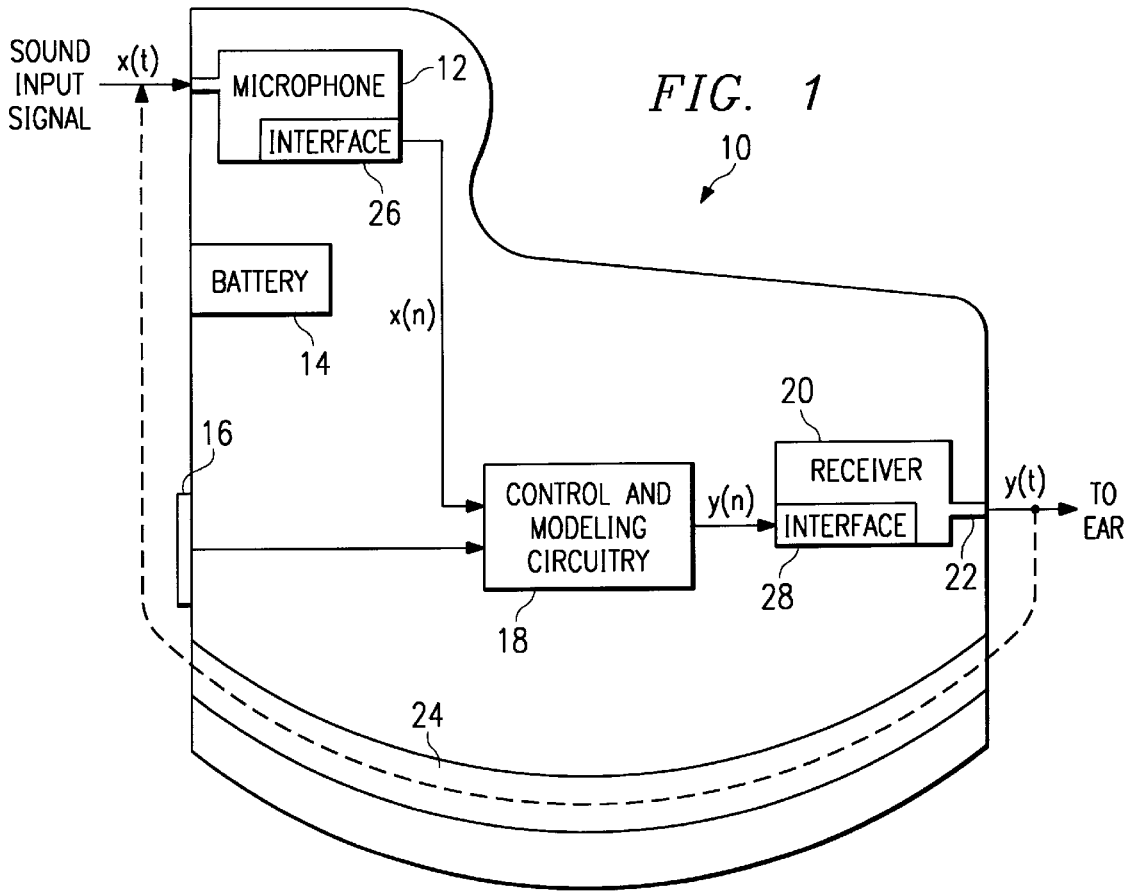
FIG. 1 is a block diagram illustrating a digital hearing aid according to the teachings of the present invention.

FIG. 1 is a block diagram of a digital hearing aid 10 according to the teaching of the present invention. Digital hearing aid 10 includes a microphone 12, a battery 14, a volume control 16, a control and modeling circuitry 18, a receiver 20, and a receiver tube 22. Digital hearing aid 10 receives an input sound signal x(t), that includes a sound signal component and a feedback signal component, at microphone 12 and generates an output sound signal which is provided to the ear of a user. The output sound signal may be referred to as an output sound signal y(t). The sound signal component represents the desired sound to be processed by digital hearing aid 10, while the feedback signal component is an undesirable feedback signal that is provide to microphone 12 through a feedback path.

Digital hearing aid 10 processes input sound signal x(t) while performing feedback path modeling and feedback neutralization. The feedback neutralization is performed on an output sound signal feedback component of the feedback signal component of input sound signal x(t). The feedback signal is the portion of the output sound signal y(t) that is provided back to microphone 12. The feedback signal will primarily be provided through a vent 24 to the input of microphone 12. The feedback signal includes two components: (1) a modified modeling signal feedback component, and (2) the output sound signal feedback component. The presence of the feedback signal, if unaccounted for, harms overall performance and results in the generation of an incorrect output sound signal y(t).

Microphone 12 receives the input sound signal x(t) and generates a corresponding digital input signal x(n) Microphone 12 may also include an interface circuitry 26 that provides any of a variety of devices such as an analog-to-digital converter, an analog filter, an amplifier controlled by an automatic gain control circuit, and any of a variety of other circuitry such as antialiasing circuitry. Microphone 12 converts the input sound signal x(t) to a corresponding electrical signal that is provided in the analog domain. Interface circuitry 26 converts the corresponding electrical signal from the analog domain to the digital domain to generate the digital input signal x(n).

Control and modeling circuitry 18 receives the digital input signal x(n) and generates digital output signal y(n) by filtering and amplifying digital input signal x(n) after neutralizing the effects of the feedback signal. Volume control 16 controls the amplification and may be implemented as a rheostat, variable resistor, or digital gain. Control and modeling circuitry 18 also generates a modeling signal v(n) which is provided as a component of the digital output signal y(n). Modeling signal v(n) is used by feedback modeling circuitry of control and modeling circuitry 18 to model the feedback path so that the effects of the feedback signal may be neutralized. Control and modeling circuitry 18 are illustrated more fully in FIGS. 2 and 3.

Receiver 20 generates output sound signal y(t) in response to receiving output sound signal y(n) from control and modeling circuitry 18. Receiver 20 may be implemented as a speaker or any device capable of receiving an input signal and generating a corresponding output sound signal. The output sound signal y(t) is then provided to the user's ear.

Receiver 20 may also include an interface circuitry 28 that is provided to convert digital output signal y(n) from the digital domain to the analog domain. Interface circuitry 28 may, for example, include any of a variety of circuitries such as a digital-to-analog converter, an analog filter, and a low pass filter. Receiver 20 then converts the electrical signal provided by interface circuitry 28 in the analog domain to the corresponding output sound signal y(t).

Interface circuitry 26 and interface circuitry 28 are illustrated in FIG. 1 as being provided as part of microphone 12 and receiver 20, respectively. However, it should be understood that the interface circuitry may be provided as discrete circuitry components provided independently or separately. The present invention is in no way limited by any one particular type of interface circuitry.

In operation, digital hearing aid 10 receives an external sound that is provided as a component of input sound signal x(t) at microphone 12. Microphone 12 generates a corresponding analog electrical signal in response to receiving the input sound signal x(t). Interface circuitry 26 converts the analog electrical signal from the analog domain to the digital domain to generate digital input signal x(n). Microphone 12 then provides the digital input signal x(n) to control and modeling circuitry 18.

Control and modeling circuitry 18 receives digital input signal x(n) and generates digital output signal y(n) in response. Control and modeling circuitry 18 amplifies and filters the digital input signal x(n) as desired. The amplification of the digital input signal x(n) may be controlled by volume control 16. Before amplifying and filtering the digital input signal x(n), control and modeling circuitry 18 eliminates or neutralizes the effects of the feedback signal provided through a feedback path. Control and modeling circuitry 18 then generates digital output signal y(n) that includes the amplified, filtered, and feedback neutralized digital input signal x(n) along with the modeling signal v(n).

The modeling signal v(n) is used by modeling circuitry, provided within control and modeling circuitry 18, to model the feedback path so that the effects of the feedback path may be neutralized and removed from digital input signal x(n). The modeling signal v(n) is provided as a component of digital output signal y(n) so that the feedback path may be modeled.

Control and modeling circuitry 18 will include digital circuitry, such as a digital signal processor, to perform the required digital signal processing. For example, control and modeling circuitry 18 may include a digital signal processor similar to those provided by Texas Instruments Incorporated. Texas Instruments Incorporated provides a family of digital signal processors including the TMS320C25 and the TMS320C30 digital signal processors. The advent of high-speed digital signal processors and related hardware have made the implementation of the present invention more practical. Many digital signal processors are implemented using a fixed-point data format. In such a case, automatic gain control circuitry must be used at each data input to extend the analog-to-digital converter dynamic range of interface circuitry 26 of microphone 12.

Receiver 20 and interface circuitry 28 receive digital output signal y(n) and generate a corresponding output sound signal y(t) that is provided through a receiver tube 22. Interface circuitry 28 converts digital output signal y(n) from an electrical signal in the digital domain to an electrical signal in the analog domain. Next, receiver 20 generates output sound signal y(t) as a sound output signal that is provided to the user's ear through receiver tube 22. Receiver 20 is typically implemented as a speaker. Battery 14 provides a source of power to the circuitry of digital hearing aid 10.

As a result of generating output sound signal y(t), a portion or component of this signal is provided as a feedback signal through vent 24 to microphone 12. The feedback signal may also be provided through other openings or passages but will primarily be provided through vent 24. The feedback signal will include a modified modeling signal component and an output sound signal feedback component. The modified modeling signal component is generated as a result of passing the modeling signal v(n) through the feedback path. The modified modeling signal component is used by control and modeling circuitry 18 to model the feedback path and to reduce the effects of the output sound signal feedback component that is provided to the input of microphone 12. The feedback path may be defined as the path from the output of control and modeling circuitry 18, through receiver 20, through vent 24, and through microphone 12.

Figure 2:
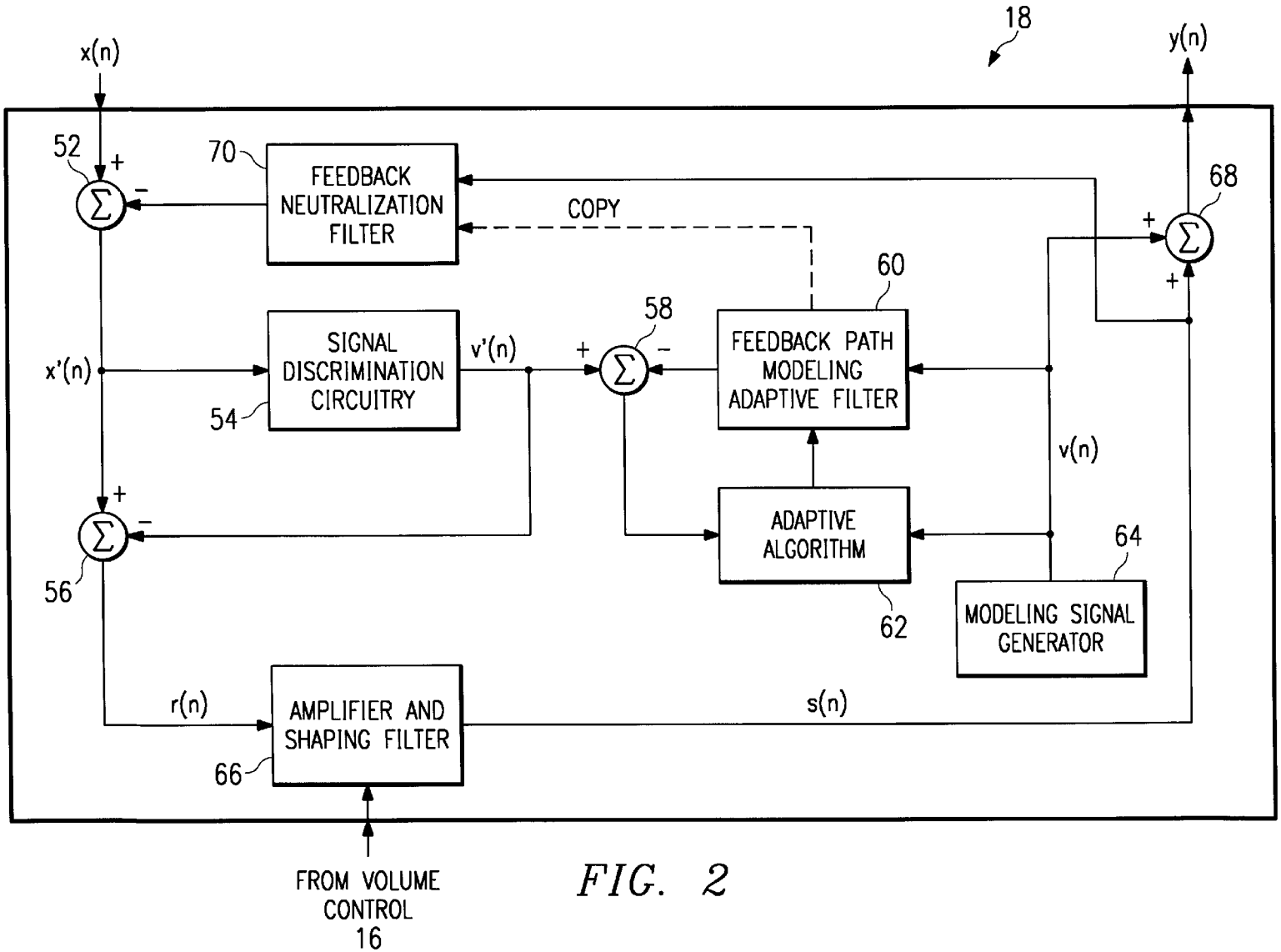
FIG. 2 is a block diagram illustrating a control and modeling circuitry of the digital hearing aid.

FIG. 2 is a block diagram of control and modeling circuitry 18 of the digital hearing aid 10. Control and modeling circuitry 18 includes a summing junction 52, a signal discrimination circuitry 54, a summing junction 56, a summing junction 58, a feedback path modeling adaptive filter 60, an adaptive algorithm 62, a modeling signal generator 64, an amplifier and shaping filter 66, a summing junction 68, and a feedback neutralization filter 70.

Digital input signal x(n) is provided to summing junction 52 where the output signal of feedback neutralization filter 70 is subtracted to generate a feedback neutralized input signal x'(n). The digital input signal x(n), just like input sound signal x(t), contains a sound signal component and a feedback signal component. The feedback signal component contains a modified modeling signal component and an output sound signal feedback component. As a result of subtracting the output signal of feedback neutralization filter 70 from the digital input signal x(n), the output sound signal feedback component of the feedback signal component is removed to generate the feedback neutralized input signal x'(n). The feedback neutralized input signal x'(n) is then provided as an input signal to signal discrimination circuitry 54 and summing junction 56.

Summing junction 56 subtracts a modified modeling signal v'(n) from the feedback neutralized input signal x'(n) to generate a processed input signal r(n). The modified modeling signal v'(n) should correspond generally to the modified modeling signal component of the feedback signal so that its effects may be removed from the feedback neutralized input signal x'(n) before the signal is amplified and filtered. As a consequence, processed input signal r(n) will then contain the sound signal component of digital input signal x(n). The processed input signal r(n) is provided to amplifier and shaping filter 66 where the signal is then amplified and filtered as desired. The amplification of the processed input signal r(n) may be controlled through volume control 16 which may be set by the user. The filtering performed by amplifier and shaping filter 66 may be fixed, pre-programmed, or programmable so that the user of digital hearing aid 10 may have the appropriate frequency spectrum or spectrums amplified as needed. Amplifier and shaping filter 66, in one embodiment, may be implemented using digital circuitry. Amplifier and shaping filter 66 provides generated output signal s(n) as its output signal. Generated output signal s(n) is then provided as summing junction 68.

Modeling signal generator 64 provides a modeling signal v(n) to summing junction 68, feedback path modeling adaptive filter 60, and adaptive algorithm 62. Modeling signal generator 64 is described in more detail below. Summing junction 68 combines the modeling signal v(n) with generated output signal s(n) to provide digital output signal y(n). Digital output signal y(n) serves as the output of control and modeling circuitry 18 and will include two components: (1) a modeling signal v(n) component; and (2) a generated output signal s(n) component. It should be noted that the modeling signal v(n) will be provided at such a level and frequency that the presence of the modeling signal v(n) in the digital output signal y(n) will be minimized or undetectable by a user of digital hearing aid 10.

The feedback path modeling and feedback neutralization is performed using the combination of feedback path modeling adaptive filter 60, adaptive algorithm 62, summing junction 58, signal discrimination circuitry 54, and feedback neutralization filter 70. The operation and implementation of the feedback path modeling and feedback neutralization circuitry are described next.

Signal discrimination circuitry 54 receives the feedback neutralized input signal x'(n) and generates the modified modeling signal v'(n) in response. The modified modeling signal v'(n) represents the modeling signal v(n) after having passed through the feedback path. Signal discrimination circuitry 54, in effect, extracts the modified modeling signal component of the feedback signal component that is included as a component of feedback neutralized input signal x'(n). Signal discrimination circuitry 54 uses a decorrelation delay unit and a digital adaptive filter to generate a predicted noise u(n) signal that does not include any component of the feedback signal. Predicted noise signal u(n) may then be subtracted from feedback neutralized input signal x'(n) to generate the modified modeling signal v'(n). Signal discrimination circuitry 54 is illustrated more fully in FIG. 3 and is described more fully below.

Modeling signal generator 64 may use any number of techniques to generate the modeling signal v(n). Modeling signal generator 64 may generate a white-noise signal, a random signal, a chirp signal, or virtually any type of signal capable of serving as a modeling signal to excite an environment or path. However, modeling signal generator 64 will generally use one of two basic techniques that can be used for random number or chirp signal generation. The first technique uses a lookup table method using a set of stored samples. The second technique uses a signal generation algorithm. Both techniques obtain a sequence that repeats itself after a finite period, and therefore is not truly random for all time.

Feedback path modeling adaptive filter 60 and adaptive algorithm 62 are used to model the feedback path and to periodically provide filter coefficient or tap settings to feedback neutralization filter 70. The feedback path, once again, being defined as the plant environment from the output of control and modeling circuitry 18, through receiver 20, through vent 24, and through microphone 12. Feedback path modeling adaptive filter 60 provides filter tap settings to feedback neutralization filter 70 every fixed number of sample periods. The fixed number of sample periods may be a programmable value and may occur every sample period or, preferably, at every fixed number of sample periods to provide acceptable overall system performance. For example, the fixed number of sample periods may occur every twenty sample periods. The sample period is inversely related to the sampling rate, which must be high enough to satisfy the Nyquist criterion such that the sampling rate must be greater than or equal to two times the highest frequency of interest.

Feedback path modeling adaptive filter 60 and corresponding adaptive algorithm 62 receive the modeling signal v(n). Adaptive algorithm 62 also receives the output signal of summing junction 58 as an input which is equivalent to the difference between modified modeling signal v'(n) and the output signal of feedback path modeling adaptive filter 60. The function of adaptive algorithm 62 is to adjust the taps or coefficients of feedback path modeling adaptive filter 60 to minimize the mean-square value of the output signal provided by summing junction 58. The output signal of summing junction 58 may be thought of as an error signal, such as a feedback path modeling error signal, to be minimized. Therefore, the filter coefficient or taps are updated so that the error signal is progressively minimized on a sample-by-sample basis.

Feedback path modeling adaptive filter 60 and adaptive algorithm 62 may be implemented using virtually any digital adaptive filter. For example, feedback path modeling adaptive filter 60 may be implemented using a finite impulse response ("FIR") filter or a transversal filter, an infinite impulse response ("IIR") filter, a lattice filter, a subband filter, or virtually any other digital filter capable of performing adaptive filtering. Preferably, feedback path modeling adaptive filter 60 will be implemented as an FIR filter for increased stability and performance. The adaptive algorithm used in adaptive algorithm 62 may include any known or available adaptive algorithms such as, for example, a least mean-square (LMS) algorithm, a normalized LMS algorithm, a correlation LMS algorithm, a leaky LMS algorithm, a partial-update LMS algorithm, a variable-step-size LMS algorithm, a signed LMS algorithm, or a complex LMS algorithm. Adaptive algorithm 62 may use a recursive or a non-recursive algorithm depending on how feedback path modeling adaptive filter 60 is implemented. For example, if feedback path modeling adaptive filter 60 is implemented as an IIR filter, a recursive LMS algorithm may be used in adaptive algorithm 62. A good overview of the primary adaptive algorithms is provided in Sen M. Kuo & Dennis R. Morgan, *Active Noise Control Systems: Algorithms and DSP Implementations*, (1996).

Feedback neutralization filter 70 is a non-adaptive digital filter and receives the tap or coefficient settings from feedback path modeling adaptive filter 60. As mentioned above, these coefficients may be copied from feedback path modeling adaptive filters 60 to feedback neutralization filter 70 every sample period or preferably, at selected intervals. Feedback neutralization filter 70 receives the tap or coefficient information and processes its input signal, generated output signal s(n), in response. Feedback neutralization filter 70 filters this signal to generate an output signal that is about equivalent to the output sound signal feedback component of the feedback signal, which is provided through the feedback path. The output signal of feedback neutralization filter 70 is then provided to summing junction 52 where the output sound signal feedback component of the feedback signal is removed or subtracted from digital input signal x(n).

In operation, control and modeling circuitry 18 receives digital input signal x(n) from microphone 12 that includes interface circuitry 26. The digital input signal x(n), just like the input sound signal x(t), may be thought of as containing a sound signal component and a feedback signal component. Once again, the feedback signal component includes at least two components, the modified modeling signal component, and the output sound signal feedback component. The digital input signal x(n) passes through summing junction 52 where the output sound signal feedback component of the feedback signal component is removed using feedback neutralization filter 70 to generate the feedback neutralized input signal x'(n). The feedback neutralized input signal x'(n) is provided to signal discrimination circuitry 54 and summing junction 56.

Signal discrimination circuitry 54 generates the modified modeling signal v'(n) in response. The modified modeling signal v'(n) is also provided as an input to summing junction 56. Summing junction 56 subtracts the modified modeling signal v'(n) from the feedback neutralized input signal x'(n) to remove the modified modeling signal component of the feedback neutralized input signal x'(n) and to generate processed input signal r(n).

Alternatively, summing junction 56 is not provided and the feedback neutralized input signal x'(n) is provided directly to amplifier and shaping filter 66. In such a case, feedback neutralized input signal x'(n) functions as processed input signal r(n) except that processed input signal r(n) will include the modified modeling signal component.

Assuming that summing junction 56 is provided, the processed input signal r(n) is received at amplifier and shaping filter 66 where the signal is amplified and filtered as desired. The amplification of the processed input signal r(n) may be controlled through volume control 16 which may be set by the user. As mentioned previously, the filtering performed by amplifier and shaping filter 66 may be fixed, pre-programmed, or programmable so that the user of digital hearing aid 10 may have the appropriate frequency spectrums amplified as needed. Normally, the user will undergo a hearing test that determines the extent of the hearing loss or hearing deficiency. The results of the hearing test can be used to determine which frequency spectrums should be amplified and by how much. This information may be programmed or fixed in the filtering circuitry of amplifier and shaping filter 66. Amplifier and shaping filter 66 provides generated output signal s(n) as its output signal. Generated output signal s(n) is then provided to summing junction 68.

Meanwhile, modeling signal generator 64 provides modeling signal v(n) to summing junction 68, feedback path modeling adaptive filter 60, and adaptive algorithm 62. Modeling signal v(n) is combined with generated output signal s(n) at summing junction 68 to generate digital output signal y(n).

Feedback path modeling adaptive filter 60 and adaptive algorithm 62 receive modeling signal v(n) and work together to model the feedback path. In doing this, the appropriate taps or coefficients of feedback neutralization filter 70 are calculated by adaptive algorithm 62 and provided to feedback neutralization filter 70 at selected intervals. As mentioned previously, these may be provided, each sample period or at selected intervals. The output of feedback neutralization filter 70 is then provided to summing junction 52 where the output sound signal feedback component of the feedback signal is removed from digital input signal x(n).

Thus, control and modeling circuitry 18 controls digital hearing aid 10 so that the digital output signal y(n) may be generated as desired. Control and modeling circuitry 18 provides feedback path modeling and neutralization circuitry to eliminate any adverse effects caused by the presence of the feedback path. As a consequence, the overall performance of digital hearing aid 10 is improved.

Figure 3:
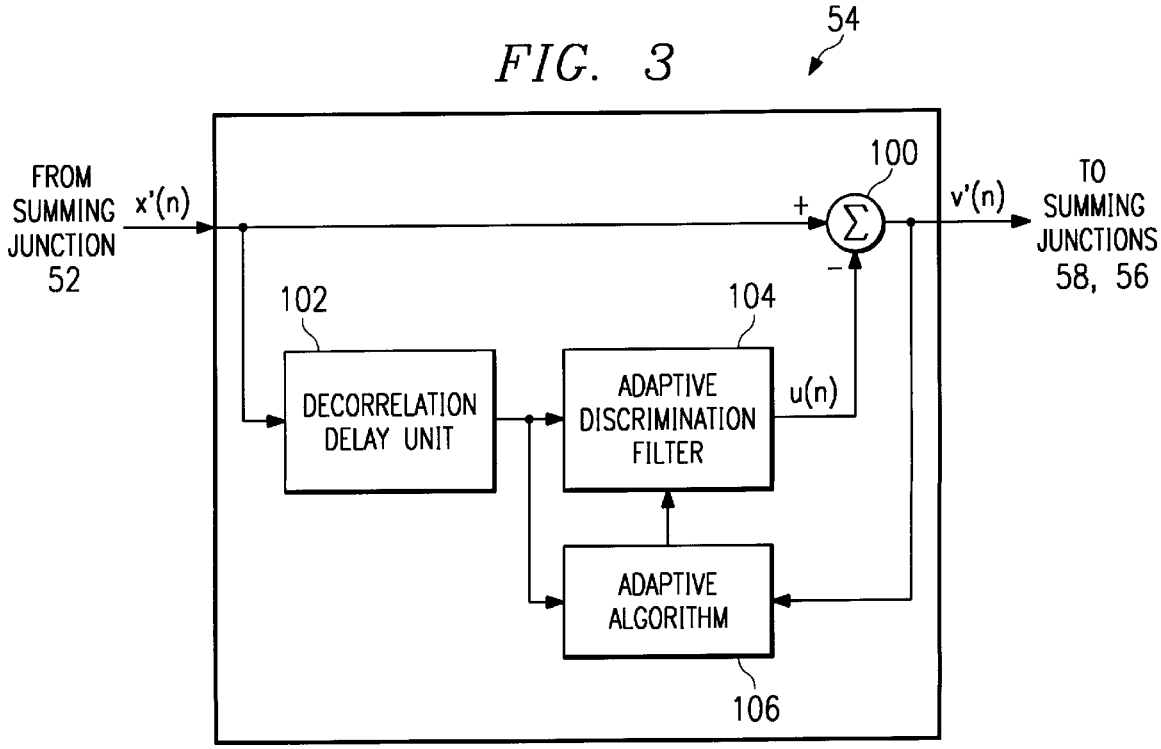
FIG. 3 is a block diagram illustrating a signal discrimination circuitry of the digital hearing aid according to the teachings of the present invention.

FIG. 3 is a block diagram of signal discrimination circuitry 54 that includes a decorrelation delay unit 102, an adaptive discrimination filter 104, an adaptive algorithm 106, and a summing junction 100. Signal discrimination circuitry 54 receives the feedback neutralized input signal x'(n) and generates the modified modeling signal v'(n) in response.

Decorrelation delay unit 102 and summing junction 100 receive the feedback neutralized input signal x'(n) from summing junction 52. Decorrelation delay unit 102 is a digital delay that delays the feedback neutralized input signal x'(n) by a selected number of sampling periods. Preferably, decorrelation delay unit 102 provides a delay that is equal to or greater than the delay provided through the feedback path. For example, the delay provide through the feedback path may be the time it takes for the feedback signal to propagate from the output of control and modeling circuitry 18, through receiver 20, through vent 24, and through microphone 12. Although the delay of decorrelation delay unit 102 is preferably set at a delay that is equal to or greater than the delay of the feedback path, performance is enhanced with a delay time as low as one sample period. Thus, the present invention encompasses a delay of one sample period or more.

Adaptive discrimination filter 104 and adaptive algorithm 106 both receive the output signal from decorrelation delay unit 102. Adaptive algorithm 106 also receives the modified modeling signal v'(n) as an input signal and uses this as an error signal. Adaptive algorithm 106 calculates the taps or coefficients for adaptive discrimination filter 104 that will minimize the modified modeling signal v'(n). In response, adaptive discrimination filter 104 receives the output of decorrelation delay unit 102 and generates predicted noise signal u(n) which is, ideally, equivalent to the sound signal component of the digital input signal x(n) and the feedback neutralized input signal x'(n). Thus, the modified modeling feedback component is removed and predicted noise signal u(n) is provided to summing junction 100 where it is subtracted from feedback neutralized input signal x'(n) to generate modified modeling signal v'(n) by removing the sound signal component of the feedback neutralized input signal x'(n) which leaves the remaining modified modeling signal component.

Adaptive algorithm 106 may be implemented using any of a variety of known and available adaptive algorithms such as those described previously in connection with adaptive algorithm 62. Adaptive discrimination filter 104 may be any type of digital filter such as an FIR or an IIR filter. Decorrelation delay unit 102 may be implemented using a computer memory or register so that a desired delay in feedback neutralized input signal x'(n) may be provided to decorrelate the modified modeling signal component of feedback neutralized input signal x'(n) while leaving the narrowband components correlated. As a consequence of the delay, adaptive discrimination filter 104 will only be able to predict or generate the signal components that remain correlated.

Thus, it is apparent that there has been provided, in accordance with the present invention, a digital hearing aid and method for feedback path modeling that eliminate or reduce the adverse effects of the feedback path on overall hearing aid operation and that satisfy the advantages set forth above. Although the preferred embodiment has been described in detail, it should be understood that various changes, substitutions, and alterations can be made herein without departing from the scope of the present invention. The circuits and functional blocks described and illustrated in the preferred embodiment as discrete or separate circuits or functional blocks may be combined into one or split into separate circuits or functional blocks without departing from the scope of the present invention. Furthermore, the direct connections illustrated herein could be altered by one skilled in the art such that two circuits or functional blocks are merely coupled to one another through an intermediate circuit or functional block without being directly connected while still achieving the desired results demonstrated by the present invention. Also, the specified signals illustrated herein could be altered by one skilled in the art such that a signal is merely processed or summed with another signal during an intermediate step while still achieving the desired results demonstrated by the present invention. For example, the feedback neutralized input signal x'(n) may be provided to amplifier and sampling filter 66 with or without having the modified modeling signal v'(n) subtracted. Other examples of changes, substitutions, and alterations are readily ascertainable by one skilled in the art and could be made without departing from the spirit and scope of the present invention as defined by the following claims.

What is claimed is:

1. A digital hearing aid comprising:

a microphone operable to receive an input sound signal and to generate a digital input signal in response;

a control and modeling circuitry operable to filter and amplify the digital input signal and to perform feedback neutralization and feedback path modeling to generate a digital output signal, said control and modeling circuitry including a first summing junction operable to subtract an output sound signal feedback component from the digital input signal to generate a feedback neutralized input signal, an amplifier and shaping filter operable to filter and amplify the feedback neutralized input signal and to generate a generated output signal in response, a modeling signal generator operable to generate a modeling signal, a second summing junction operable to combine the generated output signal with the modeling signal to generate the digital output signal, a feedback path modeling adaptive filter operable to receive the modeling signal and a modeling error signal and to filter the modeling signal to generate an output signal, a signal discrimination circuitry operable to receive the feedback neutralized input signal and to generate a modified modeling signal, a third summing junction operable to subtract the output signal from the modified modeling signal to generate the modeling error signal which is provided to an adaptive algorithm used by the feedback path modeling adaptive filter, and a feedback neutralization filter operable to receive the generated output signal and to generate a signal containing the output sound signal feedback component that is provided to the first summing junction, and wherein the adaptive algorithm used by the feedback path modeling adaptive filter is operable to calculate filter taps of the feedback path modeling adaptive filter to minimize the mean-square value of the modeling error signal, and the filter taps are provided to the feedback neutralization filter and used by the feedback neutralization filter to generate the signal containing the output sound signal feedback component; and a receiver operable, receive the digital output signal and to generate an output sound signal in response.

2. The digital hearing aid of claim 1, wherein the control and modeling circuitry further includes:

a fourth summing junction operable to subtract the modified modeling signal from the feedback neutralized input signal to generate a processed input signal, and wherein the amplifier and shaping filter is operable to receive the processed input signal and to filter and amplify the processed input signal to generate the generated output signal.

3. The digital hearing aid of claim 1, further comprising a receiver tube coupled to the receiver and operable to receive the output sound signal and to provide the output sound signal to a user of the digital hearing aid.

4. A control and modeling circuitry for filtering and amplifying a digital input signal while performing feedback neutralization and feedback path modeling to generate a digital output signal, the control and modeling circuitry comprising:

a first summing junction operable to subtract an output sound signal feedback component from the digital input signal to generate a feedback neutralized input signal;

an amplifier and shaping filter operable to filter and amplify the feedback neutralized input signal and to generate a generated output signal in response;

a modeling signal generator operable to generate a modeling signal;

a second summing junction operable to combine the generated output signal with the modeling signal to generate the digital output signal;

a feedback path modeling adaptive filter operable to receive the modeling signal and a modeling error signal and to filter the modeling signal to generate an output signal;

a signal discrimination circuitry operable to receive the feedback neutralized input signal and to generate a modified modeling signal;

a third summing junction operable to subtract the output signal from the modified modeling signal to generate the modeling error signal which is provided to an adaptive algorithm used by the feedback path modeling adaptive filter; and a feedback neutralization filter operable to receive the generated output signal and to generate a signal containing the output sound signal feedback component that is provided to the first summing junction, and wherein the adaptive algorithm used by the feedback path modeling adaptive filter is operable to calculate filter taps of the feedback path modeling adaptive filter to minimize the mean-square value of the modeling error signal, and the filter taps are provided to the feedback neutralization filter and used by the feedback neutralization filter to generate the signal containing the output sound signal feedback component.

5. The control and modeling circuitry of claim 4, further comprising:

a fourth summing junction operable to subtract the modified modeling signal from the feedback neutralized input signal to generate a processed input signal, and wherein the amplifier and shaping filter is operable to receive the processed input signal and to filter and amplify the processed input signal to generate the generated output signal.

6. The control and modeling circuitry of claim 4, wherein the signal discrimination circuitry includes:

a decorrelation delay unit operable to delay the feedback neutralized input signal and to provide a delayed feedback neutralized input signal;

an adaptive discrimination filter operable to receive the delayed feedback neutralized input signal and the modified modeling signal and to filter the delayed feedback neutralized input signal to generate a predicted noise signal; and a fourth summing junction operable to subtract the predicted noise signal from the feedback neutralized input signal to generate the modified modeling signal.

7. The control and modeling circuitry of claim 6, wherein the delay of the decorrelation delay unit is a programmable delay.

8. The control and modeling circuitry of claim 6, wherein the delay of the decorrelation delay unit is equal to or greater than the delay of the feedback path being modeled.

9. The control and modeling circuitry of claim 4, wherein the adaptive algorithm used by the feedback path modeling adaptive filter uses a least-means-square adaptive algorithm.

10. A method for modeling the feedback path of a digital hearing aid, the method comprising the steps of:

receiving a digital input signal;

generating a modeling signal;

generating filter taps for use in a feedback neutralization filter using the modeling signal and a modified modeling signal;

generating a feedback neutralized input signal using the feedback neutralization filter and the digital input signal;

generating the modified modeling signal using the feedback neutralized input signal using a digital delay that is equal to or greater than the delay of the feedback path;

generating a generated output signal by filtering and amplifying the feedback neutralized input signal; and generating a digital output signal using the generated output signal and the modeling signal.

* * * * *